US008911263B2

(12) United States Patent
Becavin

(10) Patent No.: US 8,911,263 B2
(45) Date of Patent: Dec. 16, 2014

(54) CONNECTION ASSEMBLY HAVING MULTI-CONTACT CONNECTORS WITH A POLARIZING SYSTEM USING KEYS

(71) Applicant: Radiall, Rosny Sous Bois (FR)

(72) Inventor: Patrice Becavin, Auzouer en Touraine (FR)

(73) Assignee: Radiall, Rosny Sous Bois (FR)

( * ) Notice: Subject to any disclaimer, the term of this patent is extended or adjusted under 35 U.S.C. 154(b) by 0 days.

(21) Appl. No.: 13/865,295

(22) Filed: Apr. 18, 2013

(65) Prior Publication Data

US 2013/0280950 A1 Oct. 24, 2013

(30) Foreign Application Priority Data

Apr. 18, 2012 (FR) ..... 12 53575

(51) Int. Cl.

| | |
|---|---|
| ***H01R 13/64*** | (2006.01) |
| ***H01R 13/46*** | (2006.01) |
| ***H01R 13/639*** | (2006.01) |
| ***H01R 13/645*** | (2006.01) |
| ***H01R 13/641*** | (2006.01) |

(52) U.S. Cl.

CPC ..... *H01R 13/64* (2013.01); *H01R 13/465* (2013.01); *H01R 13/639* (2013.01); *H01R 13/6453* (2013.01); *H01R 13/641* (2013.01)

USPC ..... 439/681; 439/680

(58) Field of Classification Search

CPC ..... H01R 13/6453

USPC ..... 439/362, 680, 681

See application file for complete search history.

(56) References Cited

U.S. PATENT DOCUMENTS

| | | | | |
|---|---|---|---|---|
| 3,582,867 | A | 6/1971 | Thompson et al. | |
| 4,929,184 | A * | 5/1990 | Emadi et al. | 439/681 |
| 4,934,950 | A * | 6/1990 | Green et al. | 439/681 |
| 2003/0114044 | A1 | 6/2003 | Nakamura et al. | |

FOREIGN PATENT DOCUMENTS

| | | | |
|---|---|---|---|
| DE | 197 09 811 | A1 | 9/1998 |
| DE | 103 30 853 | A1 | 2/2005 |
| DE | 20 2010 008 319 | U1 | 1/2012 |

(Continued)

OTHER PUBLICATIONS

French Search Report and Written Opinion issued in French Patent Application No. 12 53573 on Jan. 17, 2013 (with translation).

(Continued)

*Primary Examiner* — Tho D Ta

(74) *Attorney, Agent, or Firm* — Oliff PLC

(57) ABSTRACT

A connection assembly includes a first connector and a second connector, each with a housing extending along an axis and having a connection face, being connected together via their connection faces. Also included is, at least, one coupled-together pair of polarizing keys, each key being of elongate shape along an axis and projecting from one of the housings beyond its connection face. Each key includes at each one of its ends a portion with a peripheral surface that is provided with at least one projecting and/or hollow shape. Each end portion of one of the two keys is adapted to engage via complementary shapes with a single end portion of the other of the two keys along their coinciding axes and in only one relative angular position between them. Each polarizing key is fastened via one of its end portions to the housing of one of the connectors.

22 Claims, 7 Drawing Sheets

(56) References Cited

FOREIGN PATENT DOCUMENTS

| | | | | |
|---|---|---|---|---|
| EP | 1 708 313 | A2 | | 10/2006 |
| EP | 2 003 754 | A1 | | 12/2008 |
| GB | 961714 | A | * | 6/1964 |
| JP | A-61-124074 | | | 6/1986 |

OTHER PUBLICATIONS

French Search Report and Written Opinion issued in French Patent Application No. 12 53575 on Dec. 4, 2012 (with translation).

U.S. Appl. No. 13/858,419, filed on Apr. 8, 2013 in the name of Becavin, P.

* cited by examiner

CONNECTION ASSEMBLY HAVING MULTI-CONTACT CONNECTORS WITH A POLARIZING SYSTEM USING KEYS

FIELD OF THE INVENTION

The present invention provides a connection assembly comprising multi-contact connectors that are connected together and polarizing keys that enable only the desired connection to be made.

BACKGROUND OF THE INVENTION

Patent application EP 1 708 313 in the name of the Applicant discloses a connection assembly comprising a first multi-contact connector and a second multi-contact connector of complementary type. Each connector comprises a housing receiving contacts, and the connection assembly includes a cap enabling the first and second connectors to be locked together.

Another known connection assembly comprising multi-contact connectors is sold by the Applicant under the trade name Amphenol-Air LB—Series 1900. In that connection assembly, in addition to mechanical and electrical connection that is provided via their connection faces, mechanical coupling between the connectors is also provided via polarizing keys in the form of screws F1 and M1 having hexagonal heads in which the end portion is either a tongue or a corresponding slot. A screw with a hexagonal head projects from each of the two lateral ends of the housing of the male connector and from each of the two lateral ends of the housing of the female connector. Each screw head includes a notch constituted by a flat of the hexagon and constituting a first visual coding mark. At each of its two lateral ends, each housing is marked close to the complementary hexagonal recess for a screw head with a second visual coding mark in the form of a letter A or B, and above each flat of the hexagonal recess with a third visual coding mark in the form of successive digits 1 to 6. Thus, in order to perform coding with the four polarizing keys in the form of screws, each of them is inserted in a complementary hexagonal recess in a lateral end of a housing while causing the first visual coding identifier, i.e. the notch of the screw head to corresponding with the second and third visual coding identifiers, namely the letter A or B and one of the digits 1 to 6. Such a polarizing system with four polarizing keys distributed individually on each lateral end of a male or female connector housing is advantageous since it enables polarizing coding to be performed with up to 36 combinations. Nevertheless, it is not completely satisfactory, since it allows the codes to be viewed only from the rear faces of the housings, and above all it always requires an extractor tool to be used in order to remove the polarizing keys from their recesses. When snap-fastened in a connector housing, a polarizing key can be removed only from beside the coupling face (where the connectors couple together), and necessarily by applying pressure with an extractor tool.

The inventors have sought to have a connection assembly as described above and sold under the trade name Amphenol-Air LB—Series 1900, but that is also fitted with a cap that slides on one of the housings so as to enable the two multi-contact connectors to be locked together, e.g. such as the cap described in European patent application EP 1 708 313. Unfortunately, in its unlocked position, such a cap must come into register with one of the lateral ends of the housings, thus making it impossible to provide polarizing at that lateral end by using screws as provided in the commercially available assembly. In other words, the inventors have come to the conclusion that improving the commercially-available connection assembly by providing it with a cap for locking the connectors together implies having keying at only one of the two lateral ends of the housings. However, by retaining the polarizing by means of screws as is presently performed and as described above also implies making do with coding having a number of combinations that is limited, being equal to six.

There therefore exists a need to improve a connection assembly comprising two complementary connectors, in particular multi-contact connectors, such as the assembly sold under the trade name Amphenol-Air LB—Series 1900, in particular in order to fit it with a cap for locking the connectors together and with a polarizing system at only one lateral end, but with the possibility of coding on a large number of combinations.

There also exists a need to eliminate the use of a tool when removing a polarizing key from a housing of a connector, in particular a multi-contact connector.

OBJECT AND SUMMARY OF THE INVENTION

An object of the present invention is to satisfy the above-mentioned needs in full or in part.

In exemplary embodiments the invention achieves this object with the help of a connection assembly comprising:

- a first connector, in particular a multi-contact connector;
- a second connector, in particular a multi-contact connector, of type complementary to the first connector, the first and second connectors each comprising a housing extending along an axis and having a connection face, the first and second connectors being connected together via their connection faces; and
- at least one coupled-together pair of two polarizing keys, each key being of elongate shape along an axis and projecting from one of the housings beyond its connection face;

wherein each key includes at each one of its ends a portion with a peripheral surface that is provided with at least one projecting and/or hollow shape, by the fact that each end portion of one of the two keys is adapted to engage via complementary shapes with a single end portion of the other of the two keys along their coinciding axes (X1=X2) and in only one relative angular position between them, and by the fact that each polarizing key is adapted to be fastened via one or the other of its end portions to the housing of the first and/or the second connector in a plurality of given angular positions relative to the axis.

Because both of the polarizing keys can be engaged reversibly, i.e. via either end portion, the invention thus makes it possible to double the number of coding combinations in a single zone of the connection assembly.

Thus, by means of the invention, it is possible to propose a connection assembly having multi-contact connectors with a large number of coding combinations, while also providing it with a cap for locking the connectors together, the cap being slidably mounted on one of the connector housings.

In exemplary embodiments, each key projects from only one of the lateral ends of a housing beyond the connection face of the housing.

In order to identify the coding easily, it is advantageous to provide for one end portion of a key to include at its end or on its outer periphery a first visual indicator that is distinct from the visual indicator of the other end portion of the same key, each first visual indicator being visible from outside the housing when the corresponding key is fastened in the housing. Advantageously, the end portion of one of the two keys of the pair has the same first visual indicator as the end portion of the other one of the two keys of the pair with which it is adapted to engage.

Preferably, the first visual indicators are letters (A, B).

According to advantageous characteristics, the first visual indicators are made by marking the keys. Preferably, the marking results from a shape made in the mold used for making the keys when they are made by molding. Alternatively, the marking may be an operation that is performed directly on the keys after they have been made.

In advantageous exemplary embodiments, the connection face of the housings of the first and second connectors, respectively, are adapted to enable each key to be installed and removed manually. The term "installed and removed manually" as used in the present invention means that it is possible to install and remove a key by hand alone without help from any tool. Preferably the manual installation and removal of each key is performed from the connection faces of the housings. An operator can thus quickly and easily fasten the keys in the housings with a determined coding combination, and can also remove them quickly and easily.

In advantageous exemplary embodiments, a key includes a fastener collar in its central portion between its two end portions, the collar co-operating by snap-fastening with at least one elastically deformable fastener tab arranged in the housing of the first or second connector in order to fasten the key in the housing. The fastener tab(s) may be molded directly and integrally with the housing of a connector. This provides a fastener system that is simple and inexpensive for the polarizing keys. The fastener tab(s) may be generally in the form of clips.

Each housing may also include a shoulder against the rear of the fastener collar comes into abutment, while the front of the collar is snap-fastened with the tab(s). This provides a kind of double positioning and holding system for positioning and holding a key in the housing: in front by means of the fastener tab(s); and at the rear by coming into abutment against the shoulder.

Advantageously, the collar includes on its outer periphery a plurality of second visual indicators, defining a plurality of angular positions of the key relative to the axis (X), and a lateral end of a housing includes a viewing window for viewing one of the second visual indicators when the corresponding key is fastened in the housing.

In an advantageous variant, the collar is of polygonal external section transversely to the axis (X1, X2) of the key, and the lateral end of the housing defines around the tab(s) a recess of polygonal internal section complementary to the section of the collar, the housing and the collar co-operating by mutual engagement of the complementary polygonal sections in order to define one of the plurality of given angular positions for the key relative to the axis X of the housing. In other words, in this variant, the polarizing keys are advantageously prevented from turning about their axes in the given angular position because the faces of the polygonal section of the collar are blocked by the complementary faces of the recess.

According to an advantageous characteristic, the external section of the collar is octagonal.

The visualization window may be provided laterally in the recess. This is advantageous, in particular in a factory for fabricating and assembling harnesses or connectors, whenever an operator is testing the connection of a connection assembly that is polarized by means of keys in accordance with the invention. The operator can then easily see on the sides of the connectors whether the polarizing code of the second visual indicators is indeed the appropriate code.

The plurality of second visual indicators is preferably a succession of digits, such as 1 to 8. It may be achieved by marking the keys. The marking is preferably the result of a shape formed in the mold for the keys when the keys are made by molding. Alternatively, the marking may be an operation that is performed directly on the keys after they have been made.

In first exemplary embodiments, at least the collars of the two keys have the same transverse dimensions, and the housings of the first and second connectors are adapted to receive equally well a portion of a key that is of male type or of female type. In other words, in these first exemplary embodiments, either one of the two keys can be installed and/or removed equally well in association with the plug or the socket of the connection assembly. This also makes it possible to double the number of coding combinations between the housings of the two connectors. Thus, if one key has two end portions of the male type and the other key has two end portions of the female type, it is possible to receive a male key equally well either in the housing of the plug or in the housing of the socket, and likewise it is possible to receive the corresponding female key equally well in the housing of the plug or in the housing of the socket.

In second exemplary embodiments, as an alternative to the first exemplary embodiments, at least the collars of the two keys are of transverse dimensions that are different, and the lateral end of the housing of the first connector is adapted to receive only the female type portion of the key having the larger collar when snap-fastened by the tab(s), while the housing of the second connector is adapted to prevent said key having the larger collar from being snap-fastened by the tab (s).

In these second exemplary embodiments, the assembly may include a solid cylinder projecting from the lateral end of the housing of the first connector in order to prevent a male type key portion from being received therein. The second exemplary embodiments make it possible to eliminate the possibility of a key being mounted equally well in a plug housing or in a socket housing. Thus, when only a female key can be mounted in a housing of the first connector, such as a plug, its larger-size collar prevents it from being snap-fastened to the housing of the second connector. And the male key cannot then be received in the first connector, preferably because of the presence of the solid cylinder with which it interferes mechanically in the event of an attempt at inserting it therein. In other words, the second exemplary embodiments serve to prevent an operator from making a potential error of interchanging the keys between the housings of the first and second connectors, respectively.

According to an advantageous characteristic, the first and second visual indicators together define a polarizing code having a plurality of combinations (A1 to A8, B1 to B8). The number of coding combinations may be equal to 32.

The two end portions of one key are preferably of the male type while the two end portions of the other key of the pair are preferably of the female type. Thus, for a pair of two keys of the invention, it is advantageous to define one key as being of male type only and the other key as being of female type only.

In advantageous variant exemplary embodiments, a key portion of female type is constituted by a cylinder having a rectilinear slot formed therein along the cylinder, whereas a key portion of male type is constituted by a cylinder having at least one rectilinear spline formed thereon along the cylinder, complementary to the slot.

Preferably, three rectilinear slots are arranged inside the cylinder, the slots being spaced apart from one another in angular positions, and three splines are arranged on the cylinder, being spaced apart from one another in the same angular positions as the slots. It is preferable to define three slots and three corresponding splines since that makes it possible firstly to have better mechanical guidance while coupling together the two polarizing keys, and secondly to have better mechanical strength for the keys in the event of a coupling error.

The connection assembly of the invention may be adapted to be mounted on a panel.

The first and second connectors are advantageously adapted to be locked together. Thus, the first connector may include a cap slidably mounted on the housing between a locking position in which it co-operates with at least one locking peg of the second connector, and an unlocking position in which it projects beyond a lateral end of the housing opposite from its lateral end from which the corresponding polarizing key projects.

The invention also provides a set of polarizing keys for use in a connection assembly as defined above, the set comprising at least one pair of two polarizing keys each key being of elongate shape along an axis (X1, X2) and including at each of its ends a portion having a peripheral surface that is provided with at least one projecting and/or hollow shape, and by the fact that each end portion of one of the two keys in a given pair is adapted to engage by complementary shapes with a single end portion of the other one of the two keys of the same pair along their coinciding axes (X1=X2) and in only one relative angular position between them.

BRIEF DESCRIPTION OF THE DRAWINGS

The invention can be better understood on reading the following description of non-limiting embodiments thereof and on examining the accompanying drawings, in which.

MORE DETAILED DESCRIPTION

Figure 1:
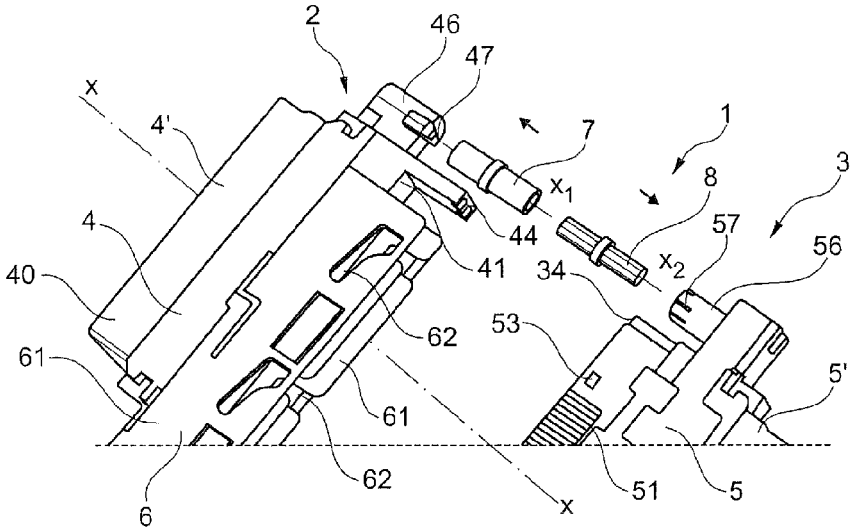
FIG. 1 is a perspective view of a connection assembly in a first embodiment of the invention, this assembling comprising a first multi-contact connector and a second multi-contact connector together with a pair of polarizing keys prior to being fastened respectively to one of the multi-contact connectors.

Throughout the present application, the terms "front", "rear", "top", and "bottom" should be considered with reference to a connection assembly of the invention having two mutually-connected connectors 2, 3. Thus, the front face of the connector 3, which can also be referred to as its "connection" face, is the face beside which the connection is made with the complementary connector 2.

FIGS. 1, 2, 7, and 8 show a connection assembly given overall reference 1 in a first embodiment of the invention. This connection assembly 1 comprises a first multi-contact connector given overall reference 2 and a second multi-contact connector given overall reference 3. The multi-contact connectors 2 and 3 are of complementary type, it being possible, by way of example, for the first connector 2 to be of the male type and in particular to be a plug, while the second connector 3 is of the female type, being in particular a socket.

However, in all of the figures described, the first connector 2 is a female plug and the second connector 3 is a male socket.

Each multi-contact connector 2, 3 conveys optical signals, electrical signals, or power. In a variant, signals or power of different types may be conveyed by each of the multi-contact connectors, in which case contacts of different sizes and different types are arranged simultaneously in the connectors.

The contacts may be single or multiple contacts such as coaxial or tri-axial contacts, quadrax contacts, RJ45 contacts, or any type of high data rate contact. The contacts may equally well be "expanded beam" type optical contacts with lenses, or "physical contact" contacts of the ARINC 801 or EN 4531 type, or indeed optoelectronic contacts.

The first multi-contact connector 2 mainly comprises a housing 4 that is made as a single piece of plastics material, in the example described.

The housing 4 includes a plurality of cells 42 arranged in the housing 4 extending from a rear face 40 to a front face 41, which face may also be referred to as a "connection" face, so as to face the second connector 3 when the connectors 2 and 3 are locked together.

In the example described, the faces 40 and 41 are parallel and extend perpendicularly to the rectilinear axis X of the cells 42, this rectilinear axis X being referred to below as the "connector axis".

The housing 4 may include two arms 43 extending beyond the connection face 41 on either side thereof, these arms 43 possibly including guide slots 44 as described in detail below. When the housing is rectangular in shape in section perpendicularly to the axis X, the arms 43 may extend parallel only to the small sides of the housing 4. The housing 4 may be made as a single portion or as two portions in order to make it easier to install holder parts as described below.

Although not shown, the first connector 2 may have an attachment portion extending the housing 4 along the axis X from its rear face 40. By way of example, this attachment portion has two branches, each having one end releasably hooked on the housing 4 and another end connected to a junction portion. The junction portion may define a plurality of attachment zones. Although not shown, each attachment zone may present a semicircular reception surface against which the cables to which the first connector 2 is connected can bear and/or be fastened.

The first connector 2 may include a front gasket (not shown) for placing on the connection face 41 of the housing 4, and the front gasket may include holes that come into register with the cells 42 when the gasket is in place on the connection face 41. By way of example, the front gasket may be made of silicone.

The first connector 2 may include a rear gasket 4' for placing against the rear face 40 of the housing 4. Like the front gasket, this rear gasket 4' may have as many holes as the housing 4 has cells 42, the holes in the rear gasket coming into register with the cells 42 when the rear gasket 4' is in place on the rear face 40 of the housing.

The cells 42 receive portions of the contacts 45 of the first connector 2. As shown better in FIGS. 11A to 11C, when the contacts 45 are in place in the housing 4, they also project out from the cells 42, i.e. in the holes in the front gasket 30, if any, so as to be cantilevered out. Each contact 45 thus includes a portion that is received in a cell 42 and a portion that projects beyond the connection face 41 of the housing 4. The portion that is received in a cell 42 may be of a length that lies in the range 50% to 75% of the length of the contacts 45.

A holder part (not shown) may be placed in each cell 42 close to the rear face 40, this holder part serving to fasten a contact 45 in the housing 4. In a variant, the holder part may be molded and incorporated in the housing 4, in particular when the housing 4 is made as two portions.

According to the invention, the first connector 2 includes a projection 46 at one of its lateral ends, the projection forming a housing with a cylindrical inside shape over a major fraction h2 of its length as constituted by its end wall. Two elastically deformable fastener tabs 47 are arranged around the recess 46 at the top end 48 of the projection, e.g. by being diametrically opposite to each other. The top end 48 of the projection 46 has an internal cross-section that is polygonal, and that is octagonal in the example described. A shoulder 49 is provided between the end wall of the recess and the top end 48 of the projection.

The functions of the recess 46 of the projection, of the fastener tabs 47, and of the shoulder 49 are described in detail below.

Similarly to the above-described first connector 2, the second connector 3 of the connection assembly 1 may comprise a housing 5 made as a single piece, a cable attachment portion (not shown), and a rear gasket 5'.

The housing 5 has a plurality of cells 52 running from a rear face 50 to a front face 51, which may also be referred to as a "connection" face, that faces the first connector 2 when the connectors 2 and 3 are locked together.

In the example described, the faces 50 and 51 are parallel and they extend perpendicularly to the rectilinear axis X of the cells 52, this rectilinear axis X also being referred to below as the "connector axis".

The cells 52 receive contacts (not shown) of complementary type to the contacts 45, for the facing cells 42.

Figure 2:
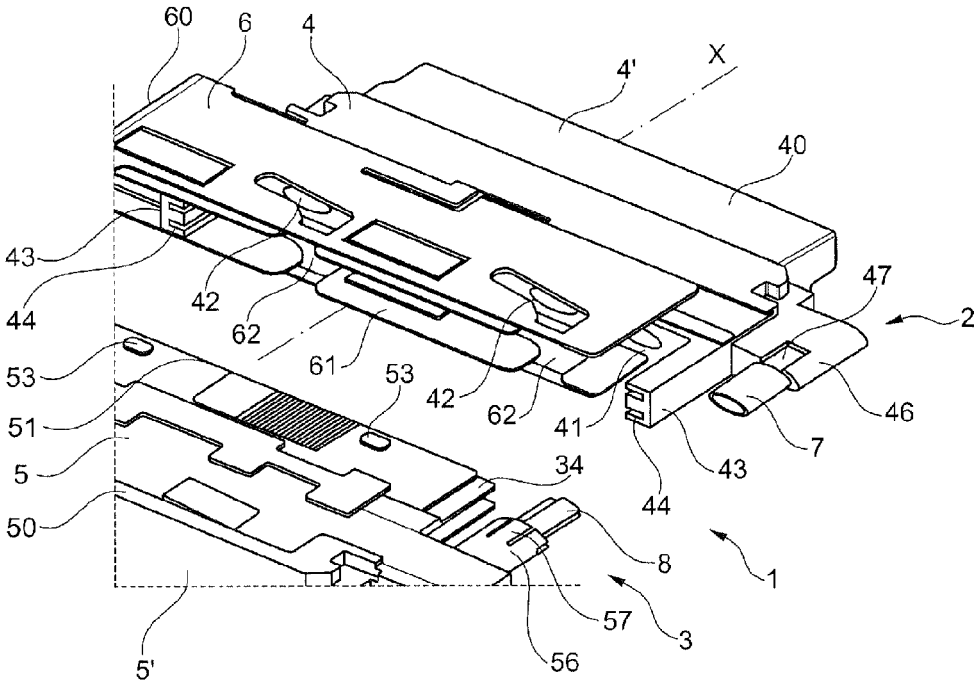
FIG. 2 is another perspective view of the FIG. 1 connection assembly, but with each of the polarizing keys fastened to a respective one of the multi-contact connectors.

As shown better in FIGS. 1 and 2, one or more locking pegs 53 may be provided at least on the top face of the housing 5. Other locking pegs may also be provided on the bottom face of the housing 5. In the examples under consideration, the locking pegs 53 are made integrally with the housing 5.

Unlike the first connector 2, the second connector 3 may include fastener means for fastening to a panel, which means are not shown.

Figure 11A:
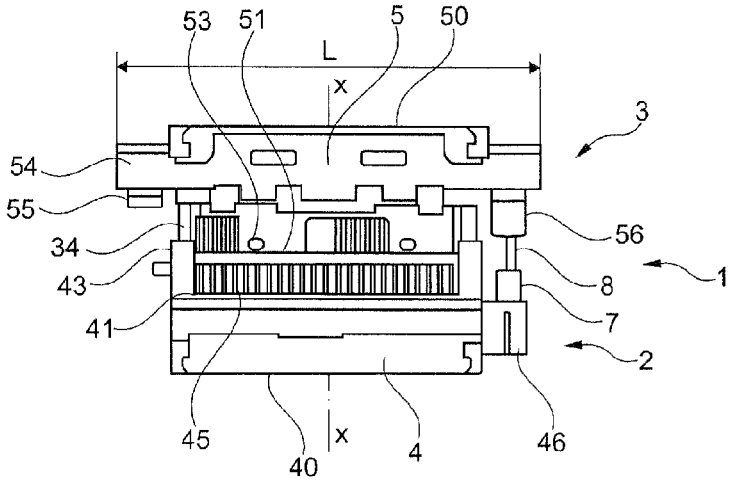
FIGS. 11A to 11C show various steps while connecting together connectors having polarizing keys in a connection assembly of the invention.
Figure 11B:
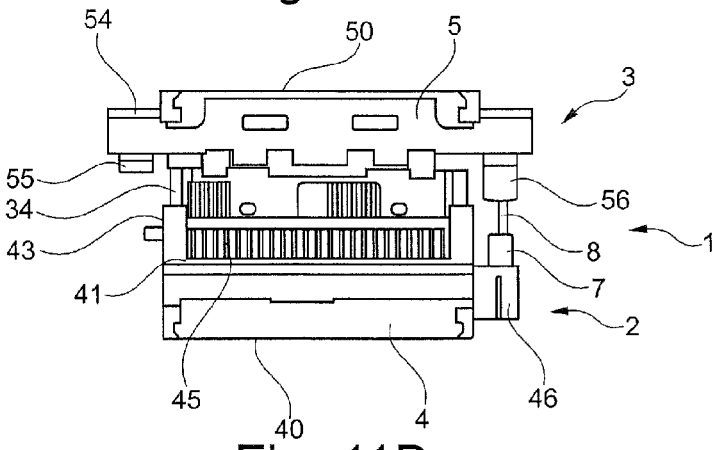
Figure 11C:
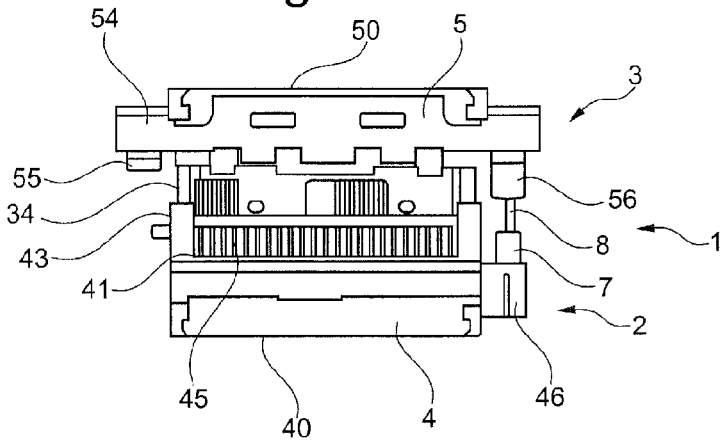

Also unlike the first connector 2, and as can be seen better in FIGS. 11A to 11C, the second multi-contact connector 3 also includes, at one of its two lateral ends, a projection 54 from which there projects a guide peg 55 serving to guide the connector 3 in an opening in a panel.

In the invention, and in similar manner to the first connector 2, the second multi-contact connector 3 also includes, at its other lateral end, a projection 56 forming a recess of cylindrical inside shape over the major fraction h3 of its length that constitutes its end wall. Two elastically deformable fastener tabs 57 are arranged around the recess 56 at the top end 58 of the projection, e.g. by being diametrically opposite each other. The top end 58 of the projection 56 has an internal cross-section that is polygonal, specifically octagonal in the example described. A shoulder 59 is provided between the end wall of the recess and the top end 58 of the projection.

The functions of the recess 56 in the projection, of the fastener tab 57, and of the shoulder 59 are described in detail below.

Finally, the second connector 3 includes guide splines 34 on either side of the front face 51 of the housing in order to co-operate with guide slots 44 of the first connector 2 so as to provide the connectors with guidance in translation along the axis X while they are being connected together. This is described in detail below with reference to FIGS. 11A to 11C.

The two multi-contact connectors 2, 3 of the connection assembly are advantageously configured to be locked together. More precisely, a locking cap 6 is mounted to slide transversely relative to the housing 4 of the first connector 2 between a locking position and an unlocking position, and back again.

As shown better in FIGS. 1 and 2, the locking cap 6 may present a U-shaped section in a plane perpendicular to the axis X of the connector 2. The cap 6 then presents an end wall 60 that faces a side face 43 of the housing 4 and two parallel branches 61 that respectively face a portion of the top face of the housing 4 and a portion of the bottom face of the housing 4.

As shown in FIGS. 1 and 2, one or more windows 62 may be formed in one of the branches 61 or in both of the branches 61. These windows 62, when observed from above or below the housing 4, may be substantially L-shaped. The long dimension measured between two opposite edges of a window 62 defines the amplitude of the sliding movement of the locking cap 6 relative to the housing 4 on passing from a locking position to an unlocking position.

As shown in FIGS. 1 and 2, in order to lock the first connector 2 and the second connector 3 together, the procedure is as follows.

During a first step, the first connector 2 with the locking cap 6 in the unlocking position is pushed, e.g. by hand, towards the second connector 3 that has previously been inserted through an opening in a panel and secured to said panel. At the end of this step, the locking cap 6 is in contact with the housings 4 and 5. Still at the end of this step, the locking pegs 53 of the housing 5 are received in the short portion of the L formed by each window 62 of the locking cap 6.

During a subsequent step, force is exerted, e.g. by hand, perpendicularly to the axis X. This force causes the locking cap 6 to slide relative to the housings 4 and 5, transversely to the axis X.

The sliding of the cap 6 causes each peg 53 to advance along the long portion of the L of each window 62. At the end of this step, each peg 53 is in abutment against an edge of the window 62 and is blocked thereagainst. The cap 6 is then in the locked position, securing the connectors 2 and 3 to each other.

As can be seen in FIGS. 11A to 11C, the maximum extent occupied by the connection assembly 1 in the example described is determined by the distance L between the two projection means 54 and 56 of the housing 5 of the second connector 3.

In an embodiment of the connection assembly 1 of the invention, the length measured along the axis X between the rear face 40 of the housing 4 and the free end of each arm 43 is 25 millimeters (mm). Still in this example, the height of the housing 4 measured between its top face and its bottom face is 14 mm, the width of the cap 6 is 62 mm, and the amplitude through which the cap 6 moves on passing from its unlocked position to its locked position, and back again, is 8 mm.

Concerning the second connector 3, the distance L between the two projections 54 and 56 as measured perpendicularly to the axis X is 80 mm, the height of the housing 5 is 14 mm, and the length of the housing 5 as measured along the axis X between the two opposite faces is 23.50 mm.

The values given above for the distances are naturally given purely by way of indication, and the values in other examples could be greater than or less than those given above.

The connection assembly 1 of the invention also includes a polarizing system constituted by a pair of polarizing keys 7, 8, each key being of elongate shape along an axis (X1, X2).

According to the invention, each key 7, 8 projects from only one of the lateral ends 46, 56 of a housing 4, 5 beyond its connection face 41, 51.

Also according to the invention, each key 7, 8 includes, at each of its ends, a respective portion 70, 71; 80, 81 with a peripheral surface that is provided with at least one projecting shape 83, 84 and/or recessed shape 73, 74.

Still according to the invention, each end portion 70, 71 of one of the two keys 7 is adapted to engage by complementary shapes with a single end portion, respectively 80, 81 of the other one of the two keys 8 along their common axis (X1=X2), and when they are in a single relative angular position.

Finally according to the invention, each polarizing key 7, 8 is adapted to be fastened via one 70, 80 or the other 71, 81 of its end portions to the housing 4 of the first connector 2 and/or to the housing 5 of the second connector 3 in a plurality of given angular positions relative to the axis (X).

In all of the figures described, the key 7 is a female key, i.e. it has two female type end portions 70 and 71, and the key 8 is of male type with two end portions 80 and 81 of male type.

Figure 3A:
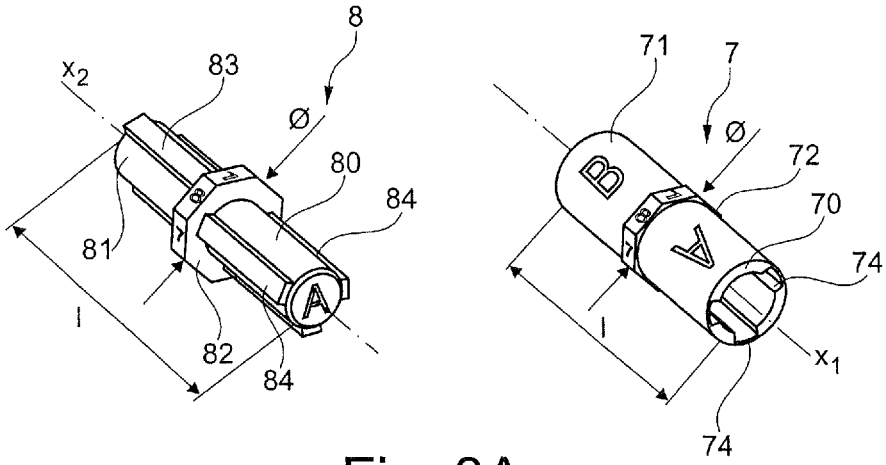
FIGS. 3A and 3B are perspective views showing an embodiment of two polarizing keys of the invention, in two different orientations and not coupled together.
Figure 3B:
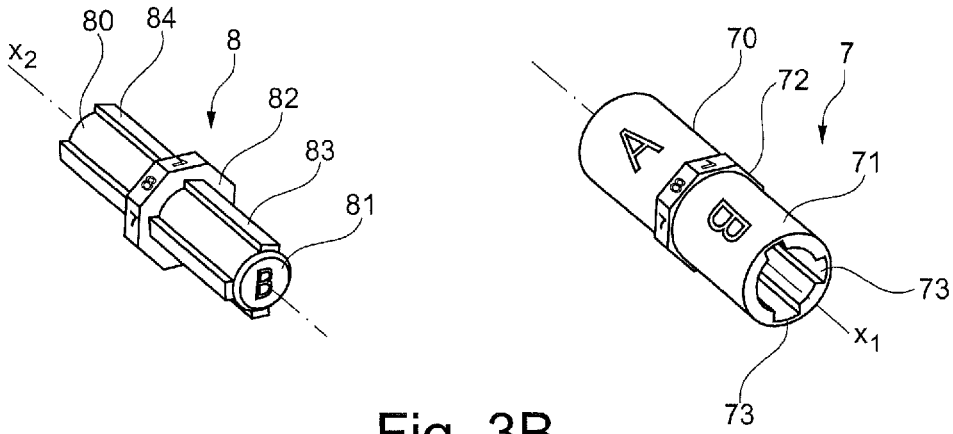

As shown in FIGS. 3A and 3B, the female key 7 has an end portion 70 on which there is marked a visual indicator A and a second end portion 71 on which there is marked a visual indicator B.

The two end portions 70 and 71 are separated by a fastener collar 72 of octagonal section. A succession of digits 1 to 8 is marked on the collar 72. More precisely, one digit is marked on each face of the octagonal section so as to form a succession. This succession can be seen in increasing order on turning the key 7 about its axis in a counterclockwise direction.

The end portion 70 is a cylinder having three rectilinear slots 74 formed therein along the cylinder, which slots are spaced apart from one another in angular positions.

The end portion 71 is a cylinder having three rectilinear slots 73 formed therein along the cylinder and spaced apart from one another with angular positions. The spacing between the slots 73 of the end portion 71 is different from the spacing between the slots 74 of the end portion 70.

In the example shown, two adjacent slots 74 are spaced apart from each other by an angle of 90°, while the third slot 74 is spaced apart from each of the other two slots 74 by an angle of 135°.

In the example shown, two adjacent slots 73 are spaced apart from each other by an angle of 180°, while the third slot 73 is spaced apart from each of the other two slots 73 by an angle of 90°.

As shown in FIGS. 3A and 3B, the male key 8 has an end portion 80 on which there is marked a visual indicator A, and a second end portion 81 on which there is a visual indicator B.

The two end portions 80 and 81 are separated by a fastener collar 82 of octagonal section. A succession of digits from 1 to 8 is marked on the collar 82. More precisely, one digit is marked on each face of the octagonal section so as to form the succession. This succession is visible in increasing order when the key 8 is turned about its axis in the clockwise direction.

The end portion 80 is a cylinder having three rectilinear splines 84 formed along the cylinder, the splines being spaced apart from one another in angular positions.

The end portion 81 is a cylinder having three rectilinear splines 83 formed along the cylinder, which splines are spaced apart from one another in angular positions. The spacing between the splines 83 of the end portion 81 is different from the spacing between the splines 84 of the end portion 80.

The three rectilinear splines 83 are of shape complementary to the three slots 73 being spaced apart from one another in the same angular positions. Thus, in the example shown, two adjacent splines 83 are spaced apart from each other at an angle of 180°, while the third spline 83 is spaced apart from each of the other two splines 83 at an angle of 90°.

The three rectilinear splines 84 are of shape complementary to the three slots 74, being spaced apart from one another at the same angular positions. Thus, in the example shown, two adjacent splines 84 are spaced apart from each other by an angle of 90°, while the third spline 84 is spaced apart from each of the other two splines 84 by an angle of 135°.

In other words, mutual engagement by complementary shapes is possible between the splines 73 and the slots 83 in only one position, defining a code B, and between the splines 74 and the slots 84 in only one position, defining a code A.

Figure 4A:
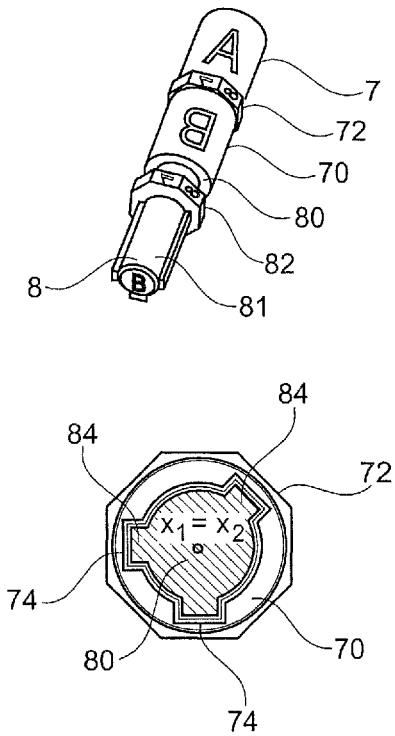
FIGS. 4A and 4B are perspective and section views of two polarizing keys of FIGS. 3A and 3B, shown coupled together.
Figure 4B:
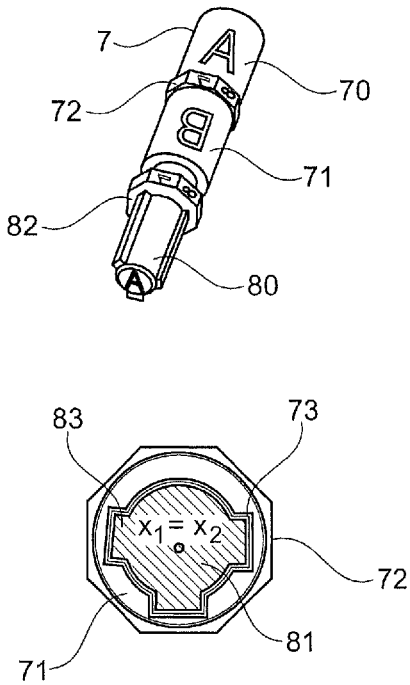

FIGS. 4A and 4B show coupling between the complementary end portions 70, 80 of the keys 7, 8 defining coding with eight combinations A1, A2, . . . , A8. Similarly, in FIGS. 4A and 4B, there can be seen coupling between the complementary end portions 71, 81 of the keys 7, 8 defining coding with eight possible combinations B1, B2, . . . , B8.

As explained below, depending on the angular positions of the keys 7, 8 relative to the axis X of the housings 4, 5 of the connectors 2, 3, it is possible to define given coding associating the letter A or B with a given digit 1 to 8 giving a maximum number of 32 combinations.

In an embodiment of the connection assembly 1 of the invention, each key 7 or 8 has a length l of 15 mm and a diameter Ø for a collar 72, 82, i.e. a distance between two facing flats of the hexagon, that is of the order of 5.5 mm. The recesses 46, 56 are of a length h of about 10 mm.

The values given above for the distances are naturally given purely by way of indication, and the values in other embodiments could be less than or greater than the values given above.

There follows a description of how the polarizing keys 7, 8 are mounted manually in the housings 4, 5 of the two connectors 2, 3.

One of the keys 7 or 8 is taken manually and is positioned firstly to define which end portion 70 or 71, or 81 is to be received in the recess 46 or 56 as formed in one of the projections of the housings 4 or 5. This orientation thus serves to show that one of the first visual indicators, A or B, that it is desired to have visible once assembly has been completed.

The key 7 or 8 is also positioned depending on the desired angular position relative to the axis X. In other words, in the example described, the faces of the octagonal section are positioned depending on the digit 1 to 8 that it is desired to see from the side of the housing 4 or 5.

Thereafter, the key 7 or 8 is inserted in the recess 46 or 56 until its fastener collar 72, 82 comes firstly into abutment against the shoulder 49, 59 made in the recess, and secondly snap-fastens with the two fastener tabs 47 or 57.

Once this snap-fastening step has been performed, the key 7 or 8 is fastened to the housing 4 or 5 of the selected connector 2 or 3, and the angular positioning determined relative to the axis X is implemented.

The same steps are performed for the other key 8 or 7 with the other housing 5 or 4 of the other connector 3 or 2 while taking care to comply with the corresponding positioning of the end portion 71 or 70, 81 or 80 in the recess 56 or 46 and the corresponding angular positioning about the axis X.

In order to remove each of the two keys 7, 8 manually, it suffices to exert a manual traction force thereon from the rear towards the front of the connector 2, 3 in which it is received. A simple traction force suffices to release the snap-fastening of the fastener tabs 47, 57 on the collar 72, 82 of the key 7, 8.

Figure 5:
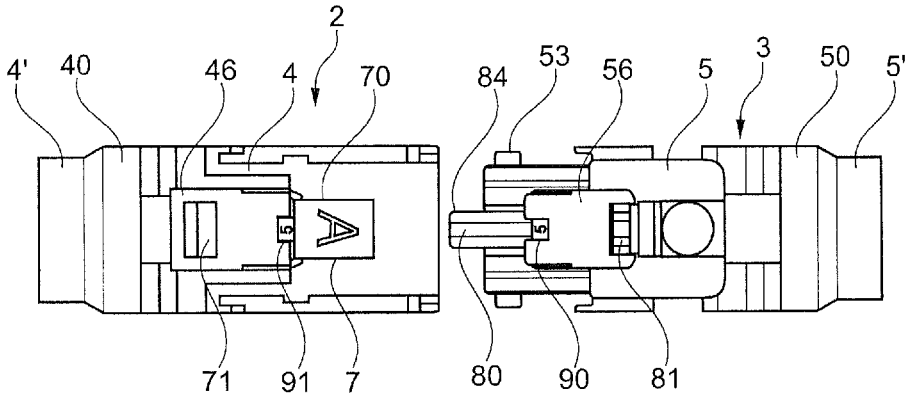
FIG. 5 is a side view of two connectors of FIGS. 1 and 2 with polarizing keys of the invention each fastened to a respective connector housing, the connectors being shown in their configuration prior to being coupled together in a determined coding combination.
Figure 6:
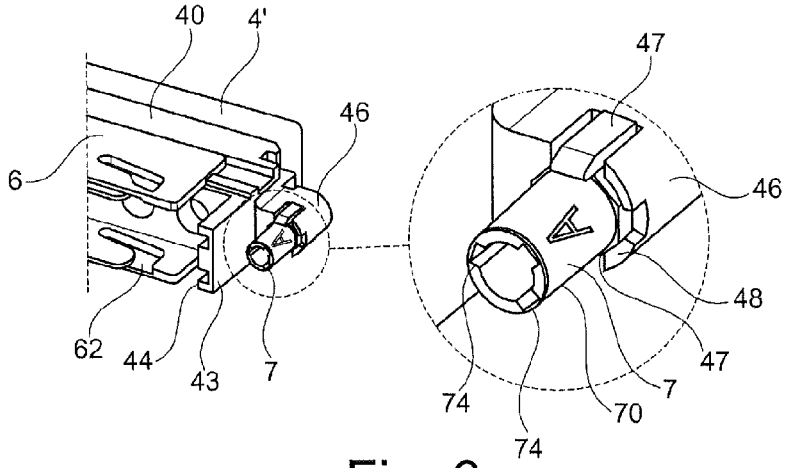
FIG. 6 is a detail view in perspective showing how one of the polarizing keys is fastened to a housing of a connector.
Figure 7:
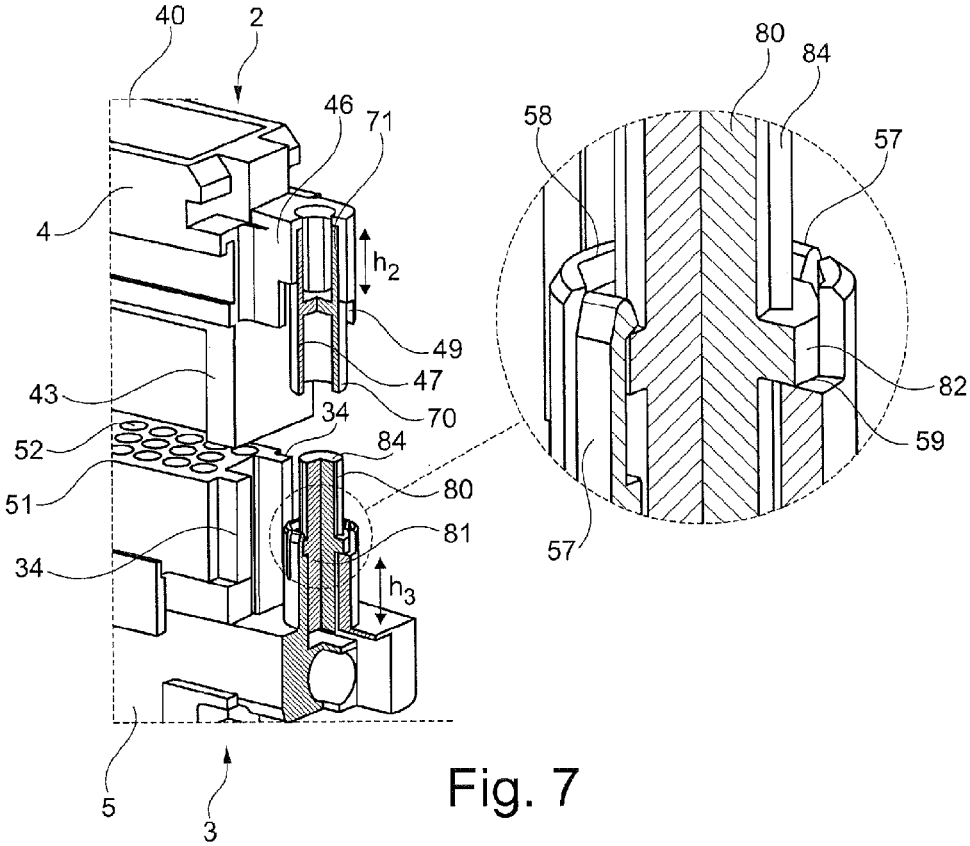
FIG. 7 is a perspective view similar to that of FIG. 2, but partially in section and showing how each of the two polarizing keys is fastened to a respective connector housing.

An example combination A5 is shown in FIG. 5. In this figure, it can be seen that the male key 8 is snap-fastened inside the recess 56 of the second connector 3 firstly so as to cause the digit 5 to appear laterally so that it can be seen through the viewing window 90 provided for this purpose in the projection 56, and secondly so as to cause the letter A to be visible at its end, which can be viewed when looking at the connection face of said second connector. In similar manner, FIG. 5 shows that the female key 7 is snap-fastened inside the recess 46 of the first connector 2 so as to cause the digit 5 to appear laterally so that it can be viewed through the viewing window 91 provided for this purpose in the projection 46, and so that the letter A can be seen laterally by viewing from the side of said first connector 2. Thus, an operator in a factory assembling the polarizing keys 7, 8 in their respective connectors 2, 3 can easily see and thus check the correct code depending on the determined combination, and specifically the code A5 as in FIG. 5.

FIGS. 1 to 7 show a first embodiment of the invention in which the female key 7 or the male key 8 can be mounted equally well on the first connector 2 or the second connector 3. This embodiment is advantageous and makes it possible to double the number of coding combinations between the housings 4, 5 up to 32 combinations in the embodiment shown.

In this first embodiment, the collars 72, 82 of the two keys 7, 8 have the same transverse dimensions, and each recess 46, 56 of the housing 4, 5 can receive equally well an end portion 70, 71 of the female key 7 or an end portion 80, 81 of the male key 8 with snap-fastening being possible in any of those configurations because of the same sizes and the same arrangement of the shoulders 49, 59 and of the fastening tabs 47, 57. Nevertheless, this first embodiment can suffer from a drawback in that it can lead to wrong assembly if an operator were inadvertently to install a male key 8 instead of and in the place of a female key 7, and vice versa.

Figure 8:
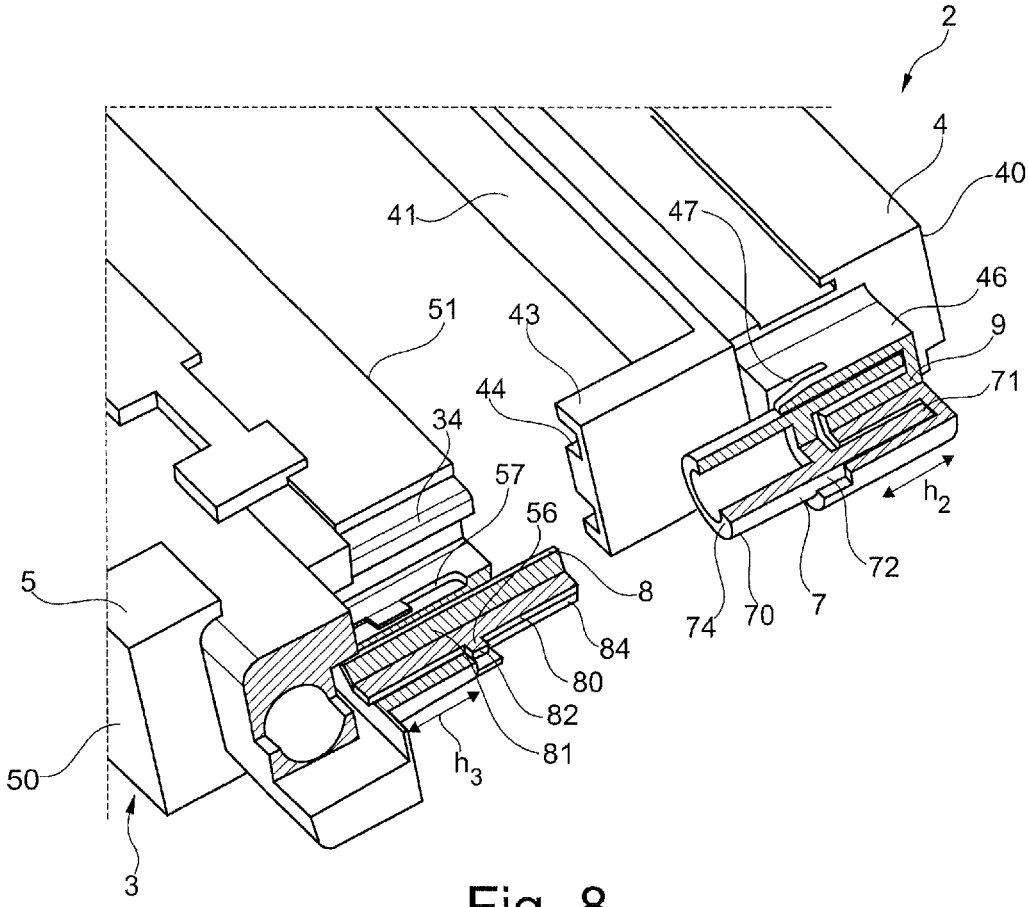
FIG. 8 is similar to FIG. 7 showing a second embodiment of the invention.
Figure 9:
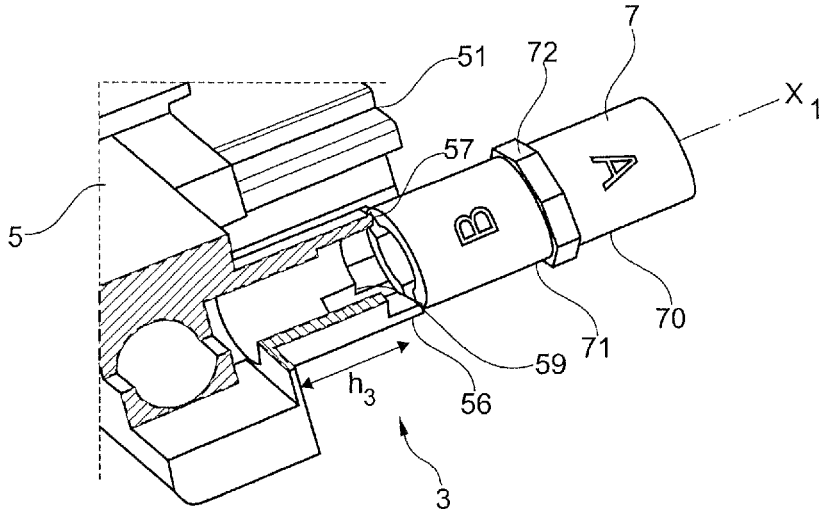
FIGS. 9 and 10 are detail views in perspective and partially in section showing the FIG. 8 embodiment and showing that it is not possible to mount polarizing keys equally well in one or the other of the connector housings.
Figure 10:
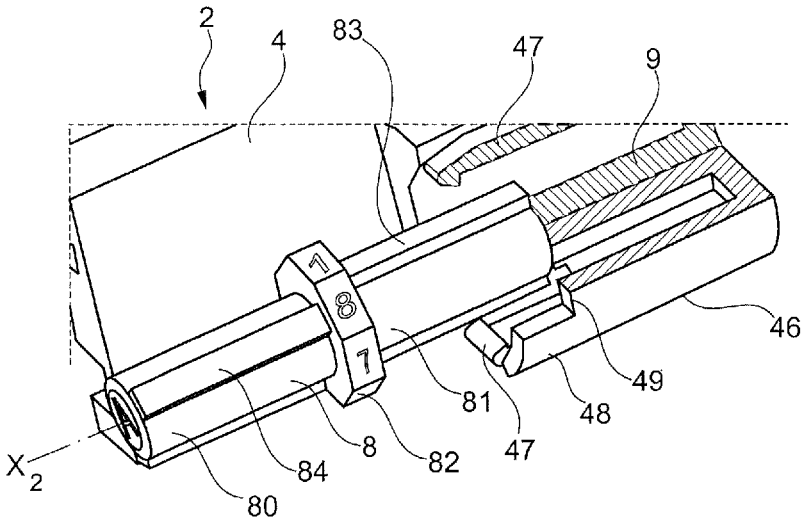

FIGS. 8 to 10 show a second embodiment that makes it possible to eliminate that drawback of the first embodiment. In other words, in this second embodiment, the female key 7 can be mounted only in one of the connectors, the first connector 2 in the embodiment shown. Likewise, the male key 8 can be mounted in only one of the connectors, the second connector in the embodiment described.

In this second embodiment, the transverse dimensions of the collar 72 of the female key 7 are made larger than those of the collar 82 of the male key 8, thereby preventing the female key 7 from being mounted in the recess 56 of the housing 5 that is adapted solely to receive the male key 8. In this second embodiment, the transverse dimensions of the end portions 70, 71 of the female key may also be enlarged. The resulting mechanical interference between the female key 7 and the recess 56 is shown in FIG. 9: in this figure, it can clearly be seen that the female key 7 comes into abutment against the periphery of the recess 56 without it being possible for it to be received therein.

Also in this second embodiment, the end wall of the recess 46 in the housing 4 is adapted solely to receiving the female key 7 and is fitted with a solid cylinder 9. When the female key 7 is inserted into the recess 46, the solid cylinder 9 penetrates into the inside of one of the end portions 70, 71 without that leading to any problem of assembly. If an attempt is made to insert the male key 8 in the recess 46, the solid cylinder 9 comes into abutment against the male key 8 and thus prevents it from being snap-fastened. The mechanical interference between the solid cylinder 9 and the male key 8 is shown in FIG. 10. In this figure, it can clearly be seen that the male key 8 comes into abutment against the solid cylinder 9.

Naturally, although FIGS. 8 to 10 show a configuration in which it is impossible to insert the female key 7 in the second connector 3 (socket) or the male key 8 in the first connector 2 (plug), it is naturally possible to provide the inverse configuration.

The connection steps, i.e. the steps of mechanically and electrically connecting the connectors 2 and 3 with their contacts together and mechanically coupling them via the polarizing keys 7, 8 are shown in FIGS. 11A to 11C.

Firstly, the housings 4, 5 of the connectors 2, 3 are put into alignment on their axis X so that their connection faces 41, 51 are facing each other. In establishing this alignment, the guide slots 44 in the arms 43 of the housing 4 of the first connector 2 are put into contact with the guide splines 34 of the housing 5 of the second connector 3, as shown in FIG. 11A.

Then the housings 4, 5 are slid towards each other with the help of the guide slots 44 and splines 34 until the two polarizing keys 7, 8 are put into contact, as shown in FIG. 11B.

If the two facing end portions 70, 80 or 71, 81 of the two polarizing keys 7, 8 can be mutually engaged, then the housings 4, 5 can continue to be slid towards each other, thereby making it possible to continue establishing the connection between the housings 4, 5 and mechanical coupling between the polarizing keys 7, 8, as shown in FIG. 11C.

Once connection has been completed, the connection faces 41, 51 are in contact flat against each other.

The invention is not limited to the above-described embodiments.

The term "comprising a" should be understood as meaning "comprising at least one", unless specified to the contrary.

What is claimed is:

1. A connection assembly comprising:

a first connector;

a second connector of type complementary to the first connector, the first and second connectors each comprising a housing extending along a first axis and having a connection face, the first and second connectors being connected together via their connection faces; and at least one coupled-together pair of two polarizing keys, each key being of elongate shape along a second axis and projecting from one of the housings beyond its connection face;

wherein each opposite ends of each key includes a portion with a peripheral surface that is provided with at least one projecting and/or hollow shape, wherein each end portion of one of the two keys is adapted to engage via complementary shapes with a single end portion of the other of the two keys along their coinciding axes and in only one relative angular position between them, and wherein each key is adapted to be fastened via one or the other of its end portions to the housing of the first and/or the second connector in a plurality of given angular positions around the first axis.

2. A connection assembly according to claim 1, wherein each key projects from only one of the lateral ends of a housing beyond the connection face of the housing.

3. A connection assembly according to claim 1, wherein one end portion of a key includes at its end or on its outer periphery a first visual indicator that is distinct from the visual indicator of the other end portion of the same key, each first visual indicator being visible from outside the housing when the corresponding key is fastened in the housing.

4. A connection assembly according to claim 3, wherein the end portion of one of the two keys of the pair has the same first visual indicator as the end portion of the other one of the two keys of the pair with which it is adapted to engage.

5. A connection assembly according to claim 3, wherein the first visual indicators are letters.

6. A connection assembly according to claim 3, wherein the first visual indicators are made by marking the keys.

7. A connection assembly according to claim 1, wherein the housings of the first and second connectors, respectively, are adapted to enable each key to be installed and removed manually.

8. A connection assembly according to claim 7, wherein each key of the coupled-together pair includes a fastener collar in its central portion between its two end portions, the fastener collar co-operating by snap-fastening with at least one elastically deformable fastener tab arranged in a housing of the first or second connector in order to fasten the key in the housing.

9. A connection assembly according to claim 8, wherein each housing includes a shoulder against a rear of the fastener collar comes into abutment, while a front of the fastener collar is snap-fastened with the tab(s).

10. A connection assembly according to claim 8, wherein the fastener collar includes on its outer periphery a plurality of second visual indicators defining a plurality of angular positions of the key relative to the second axis, and by the fact that a lateral end of a housing includes a viewing window for viewing one of the second visual indicators when the corresponding key is fastened in the housing.

11. A connection assembly according to claim 10, wherein the collar is of polygonal external section transversely to the second axis, and wherein the housing defines around the tab(s) a recess of polygonal internal section complementary to the section of the collar, the housing and the collar co-operating by mutual engagement of the complementary polygonal sections in order to define one of the plurality of given angular positions for the key relative to the first axis.

12. A connection assembly according to claim 8, wherein the first collar is of octagonal external section.

13. A connection assembly according to claim 10, wherein the plurality of second visual indicators is a succession of digits.

14. A connection assembly according to claim 8, wherein the fastener collars of at least one of the coupled-together pair of two keys have the same transverse dimensions, and wherein the housings of the first and second connectors are adapted to receive equally well a portion of a key of male type or of female type.

15. A connection assembly according to claim 8, wherein the fastener collars of at least one of the coupled-together pair of two keys are of transverse dimensions that are different, and wherein the housing of the first connector is adapted to receive only the female type portion of the key having the larger collar when snap-fastened by the tab(s), while the housing of the second connector is adapted to prevent said key having the larger collar from being snap-fastened by the tab (s).

16. A connection assembly according to claim 1, wherein the key includes a collar in its central portion with a plurality of second visual indicators on its outer periphery and wherein the first and second visual indicators together define a polarizing code having a plurality of combinations.

17. A connection assembly according to claim 1, wherein the coupled-together pair of keys includes one key of female type and one key of male type, a portion of the female type key including a cylinder having at least one rectilinear slot formed therein along the cylinder, and a portion of the male type key includes a cylinder having at least one rectilinear spline formed thereon along the cylinder, complementary to the slot.

18. A connection assembly according to claim 1, wherein one of the first or second connectors is adapted to be mounted on a panel.

19. A connection assembly according to claim 1, wherein the first and second connectors are to be locked together.

20. A set of polarizing keys intended for use in a connection assembly according to claim 1.

21. A connection assembly according to claim 1, wherein the first connector is a multi-contact connector.

22. A connection assembly according to claim 1, wherein the second connector is a multi-contact connector.

* * * * *